United States Patent [19]

Kneip, Jr. et al.

[11] Patent Number: 5,063,651

[45] Date of Patent: Nov. 12, 1991

[54] METHOD OF MANUFACTURING A LOW EMISSIVITY LIQUID NITROGEN DEWAR

[75] Inventors: George D. Kneip, Jr., Menlo Park; George Chmyz, Palo Alto; Marvin H. Anderson, Mountain View, all of Calif.

[73] Assignee: Varian Associates, Inc., Palo Alto, Calif.

[21] Appl. No.: 370,084

[22] Filed: Jun. 21, 1989

Related U.S. Application Data

[60] Continuation of Ser. No. 136,500, Dec. 28, 1987, abandoned, which is a continuation of Ser. No. 437,080, Oct. 29, 1982, abandoned, which is a division of Ser. No. 879,290, Feb. 21, 1978, abandoned.

[51] Int. Cl.[5] ..... B21D 39/00

[52] U.S. Cl. ..... 29/455.1; 220/422; 29/458; 156/665

[58] Field of Search ..... 29/455.1, 458; 220/421, 220/422, 423, 424, 425; 156/665

[56] References Cited

U.S. PATENT DOCUMENTS

| | | | |
|---|---|---|---|
| 528,513 | 10/1894 | Davis | 156/665 X |
| 2,108,603 | 2/1938 | Mason | 204/33 |
| 2,116,199 | 5/1938 | Held . | |
| 2,643,022 | 6/1953 | Cornell | 220/424 |
| 2,650,157 | 8/1953 | Cochran | 156/665 |
| 2,729,357 | 1/1956 | Nason, Jr. et al. | 220/425 |
| 2,729,551 | 1/1956 | Cohn | 156/665 |
| 2,776,069 | 1/1957 | Zimmermann | 220/424 X |
| 2,845,199 | 7/1958 | Putman et al. | 220/424 |
| 3,191,795 | 6/1965 | Molnar | 220/424 |
| 3,438,115 | 4/1969 | Humphress et al. | 220/425 X |

*Primary Examiner*—Joseph M. Gorski
*Assistant Examiner*—S. Thomas Hughes
*Attorney, Agent, or Firm*—Edward H. Berkowitz

[57] ABSTRACT

A liquid nitrogen Dewar includes a spun can for the liquid nitrogen, which spun can is surrounded by an exterior shell. Between the exterior shell and the can is an evacuated space containing a second shell that functions as a radiation shield. The can and both shells are formed of an aluminum alloy having a very high percentage of aluminum. The exterior can surface, interior surface of the exterior shell, and both surfaces of the second shell have clean, non-pitted, smooth, matted, smut free and etched appearances free from discoloration and stains so that these surfaces have low radiation emissivity properties and there is a minimum amount of radiant energy transmitted from the exterior shell to the can and reduced heating of the liquid nitrogen in the can. Each of the surfaces is initially polished, either mechanically, electrochemically or chemically, and then chemically treated with an etchant of nitric acid and hydrofluoric acid for a sufficient duration to achieve the desired appearance.

8 Claims, 1 Drawing Sheet

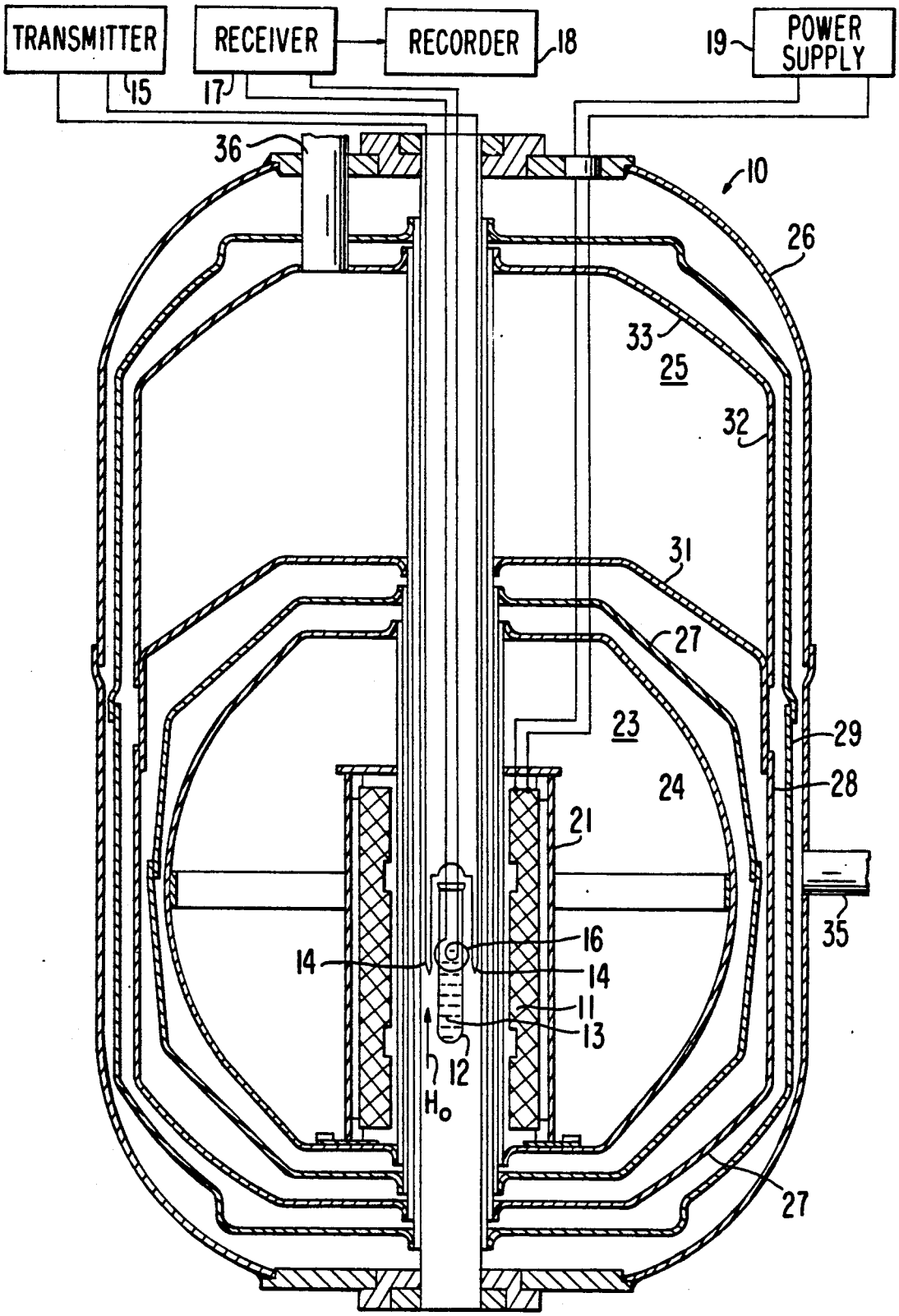
TRANSMITTER
RECEIVER
RECORDER
18
19
POWER SUPPLY
15
17
36
10
26
33
25
32
31
27
23
29
24
28
21
35
16
14
14
11
13
12
$H_o$
27

METHOD OF MANUFACTURING A LOW EMISSIVITY LIQUID NITROGEN DEWAR

This application is a continuation of application Ser. No. 07/136,500, filed 12-28-87, now abandoned, which is a continuation of application Ser. No. 437,080, filed 10-29-82, now abandoned, which is a division of application Ser. No. 879,290, filed 02-21-78, now abandoned.

FIELD OF INVENTION

The present invention relates generally to liquid nitrogen Dewars and to a method of fabricating same, and more particularly, to a liquid nitrogen Dewar having low radiation emissivity surfaces with clean, non-pitted, smooth, matted, smut free and etched appearances free from discoloration and stains as a result of being chemically treated by an etchant of nitric acid and hydrofluoric acid.

BACKGROUND OF THE INVENTION

Containers or Dewars for maintaining nitrogen in a liquid, cryogenic condition are usually formed as a metal can in which the liquid nitrogen is loaded; the can is usually surrounded by a shell. The volume between the can and shell is evacuated to decrease the heat conduction from outside of the shell to the interior of the can. In addition, it is usually desired to minimize the transmission of radiant energy from outside of the shell to the exterior surface of the can.

In the prior art, relatively low amounts of radiation have been transmitted between the shell and exterior of the can by forming both the can and the shell of an aluminum alloy having a very high percentage, such as 99%, of aluminum. The interior of the shell and exterior of the can are usually mechanically polished to a lustrious high-gloss, an operation that also substantially removes tool marks applied to the shell and can during the machining of these parts. After the can and shell have been mechanically polished, they are vapor degreased to remove filings, dirt and other foreign materials from the can and shell surfaces so these surfaces have relatively low radiant energy emissivities of approximately 0.024 at the temperature of liquid nitrogen, 77K. Radiant energy emissivity is defined in the usual manner, i.e., as the ratio of radiation emitted by a surface to the radiation emitted by a perfect black body radiator at the same temperature.

While the prior art techniques for reducing the emissivity of the shell and can are satisfactory for many purposes, the emissivity was not sufficiently reduced for other purposes. In particular, if it is desired to maintain the nitrogen in a liquid state for a prolonged duration, such as three months, the emissivity of the prior art can and shell are excessively high if the aluminum is only polished.

BRIEF DESCRIPTION OF THE INVENTION

In accordance with the present invention, there is a substantial reduction in the radiation emissivity of spun cans and shells formed of sheet aluminum alloy utilized in Dewars for liquid nitrogen. The reduction in emissivity is attained because the interior shell and exterior can surfaces have clean, non-pitted, smooth, matted, smut free and etched appearances free from discoloration and stains resulting from the polished surfaces being chemically treated with an etchant of nitric acid and hydrofloric acid. (The term "smut free" is well known to those skilled in the aluminum processing art and means that the surface is not gray or black.) The surfaces are chemically treated by the etchant for between 15 and 45 seconds, until the desired appearances are attained, which usually occurs when one mil has been removed. If the surface is treated for less than an adequate time, it is not sufficiently cleaned, matted or smut free and may be discolored or stained. If the surface is treated for an excessive duration, it becomes pitted and is not smooth. In either situation, the emissivity of the surface is increased compared to the emissivity for the proper treatment duration. Tests conducted on Dewars with surfaces made in accordance with the present invention indicate approximately a 35% reduction in emissivity compared to the prior art.

The aluminum sheet can be polished either mechanically, electrochemically or chemically. If a mechanical means are employed, the procedure is identical with the prior art. Electrochemical, i.e., electrolytic, polishing is achieved in an 85 F., bath of fluoboric acid (2.5% by weight), at a current density of 10 to 20 amperes per square foot and voltages of 15 to 30 volts, for 5 to 10 minutes, as described in U.S. Pat. No. 2,108,603. If chemical polishing is employed, the polishing is with an aqueous bath of phosphoric and nitric acids, as disclosed in U.S. Pat. No. 2,729,551, or in a bath of phosphoric, acetic and nitric acids, as disclosed in U.S. Pat. No. 2,650,157.

While it is realized that aluminum surfaces have been previously treated with an etchant of nitric acid and hydrofluoric acid after having been mechanically polished, the prior art procedures have generally been in connection with the manufacture of vacuum devices where radiation emissivity is not a factor. The present invention utilizes the prior art technique to achieve the unexpected result of reduced radiation emissivity to assist in maintaining a cryogenic Dewar at liquid nitrogen temperatures.

In accordance with another aspect of the present invention, the evacuated space between the can for liquid nitrogen and the exterior shell of the Dewar includes a second shell of spun aluminum alloy having opposite faces with the same low emissivity characteristics as the shell interior and can exterior surfaces. Thereby the exterior surface of the second shell absorbs a small percentage of the radiation emitted from the interior surface of the first shell, and the interior surface of the second shell emits a small amount of radiant energy in the direction of the can.

It is, accordingly, an object of the present invention to provide a new and improved liquid nitrogen Dewar and to a method of forminc same.

Another object of the present invention is to provide a liquid nitrogen Dewar having reduced radiant energy emissivity, and to a method of forming same.

Another object of the invention is to provide a new and improved liquid nitrogen Dewar capable of storing liquid nitrogen for extremely long time intervals, such as 90 days, and to a method of making such a Dewar.

The above and further objects and features, as well as advantages, of the invention will become apparent from the following description of the drawing.

BRIEF DESCRIPTION OF THE DRAWING

The sole FIGURE is a cross-sectional view of a Dewar manufactured in accordance with the present invention.

DETAILED DESCRIPTION OF THE DRAWING

Reference is now made to the single FIGURE of the drawing wherein Dewar 10 is illustrated as being utilized in connection with a nuclear magnetic resonance (NMR) spectrometer, including a superconducting solenoid coil 11 that supplies a relatively high intensity magnetic field $H_o$ longitudinally of the coil through a sample 13 that is located in vial 12. Sample 13 is excited to nuclear magnetic resonance by rf energy supplied to coils 14 by rf pulse source 15. Coils 14 are wound so that the axes thereof are at right angles to field $H_o$. A pick-up coil 16, located in proximity to sample 13 and responsive to energy radiated from the sample, supplies a suitable signal to rf receiver 17. Coil 16 is disposed so that its axis is at right angles to the axes of coils 14, as well as to the direction of field $H_o$. Receiver 17 may include suitable Fourier analysis equipment for deriving an output which is supplied to X-Y recorder 18, that plots the spectral response of sample 13 to different frequencies of transmitter 15. Power is initially supplied to coil 11 by a DC power supply 18, which is disconnected from the coil when it is operating in the persistent, superconductor mode.

Coil 11 is maintained at a superconducting state, at the temperature of liquid helium (4.2° K.) because it is located in cylinder 21, which in turn is surrounded by a liquid helium reservoir 23 that is contained in can 24. Can 24 is below a liquid nitrogen reservoir formed by can 25. Cans 24 and 25 are inside of shell 26 that forms the exterior of the Dewar. Between the exterior of can 24 and the interior of shell 26 is an evacuated volume, except for the region where can 25 is located. In the evacuated volume are thermal shields 27, 28 and 29. Shield 27 is located between the exterior surface of can 24 and the interior surface of shield 28, as well as between floor 31 of can 25 and the exterior of can 24. Shield 29 is positioned between the exterior wall of shield 28 and the interior wall of shell 26, as well as between side wall 32 and roof 33 of can 25 and the interior surface of shell 26.

Each of cans 24 and 25, as well as shell 26 and shields 27, 28 and 29 is a substantially isothermal surface formed of spun sheets of aluminum alloy having a very high percentage of aluminum. Preferably, the aluminum alloy is 1100-0, an alloy that is readily available from many manufacturers, such as Reynolds or Alcoa. The alloy has an aluminum content of at least 99%, a maximum iron and silicon content of 1%, a maximum copper content of 0.2%, a maximum manganese content of 0.05% and a maximum zinc content no greater than 0.1%.

To minimize radiant energy transfer between the interior surface of shell 26 and the exterior surface of can 25, the interior surface of the shell, the exterior surface of the can, and both surfaces of shield 29 have low thermal emissivity because they are specially processed to have clean, non-pitted, smooth, matted, smut free and etched appearances free from discoloration and stains. All of these surfaces are processed in the same way to achieve the desired results.

After can 25, shell 26 and shield 29 have been spun, they are polished, either mechanically, electrolytically or chemically. Mechanical polishing involves the usual buffing operations so that the surface of interest has a lustrous, high gloss and which results in removal of substantially all tool marks from the spinning operation. Electrolytic or chemical polishing, which are much less expensive and therefore more desirable than mechanical polishing, can be achieved as discussed supra. After the surface has been polished, the part is vapor degreased in a bath of liquid trichylorethelyne that emits vapors to remove dirt, filings and other foreign materials. The part is then cleaned with a detergent, such as Oakite 27, which is removed from the part with a hot tap water rinse.

The surface of interest is then chemically treated with an etchant solution of approximately 20%, by volume, of nitric acid, 4%, by volume, of hydrofluoric acid and the remainder of de-ionized water. The etchant attacks the surface for between 15 and 45 seconds, so that approximately 1 mil is removed, whereby phosphates or chromates that may have adhered to the surface during the chemical polishing are removed, and the surface has the desired non-pitted, smooth, matted, smut free and etched appearance that is free from discoloration and stains. Initially, the etchant bath has the stated proportions. After the etchant bath has been used for a while, the proportions change somewhat. The acid content is controlled in response to periodic testing of specific gravity and chemical analysis. If these tests indicate a substantial change in the acid percentages, e.g. decreases of about one-fourth in the percentages, additional acid is added or a tank holding the bath is cleaned and a new mixture is employed.

The part is then rinsed with cold tap water, and then twice rinsed with deionized water. Following the second deionized water rinse, the part is dried in a suitable tunnel, cooled and then inserted into a polyethelyne bag for protection purposes.

The Dewar is assemblied by suitably bonding the various parts together, as illustrated in the Figure. Then, a vacuum is drawn on the entire Dewar 10 through port 35 in shell 26 so all of the regions between the various cans and shields are evacuated to approximately $10^{-5}$ torr. Can 25 is then filled with liquid nitrogen through port 36, causing can 24 to be ultimately lowered to the temperature of the liquid nitrogen. Then, can 24 is filled with liquid helium through a port (not shown) to lowet the temperature of superconducting solenoid 11 to the temperature of liquid helium, 4.2° K.

The surfaces of shell 26, can 25 and shield 29 which were prepared in accordance with the present invention have been found to have radiant energy emissivities considerably less than the prior art. Prior art spun aluminum surfaces fabricated from the same alloy as used to fabricate can 25, shell 26 and shield 29 that were mechanically, electrochemically or chemically polished, but which have not been etched with the nitric acid and hydrofluoric acid mixture, have generally had radiant energy emissivities of approximately 0.024 at 77° K. In contrast, the surfaces which were chemically treated by the nitric acid and hydrofluoric acid etchant had radiant energy emissivities of approximately 0.016 at 77° K. From the foregoing, there is approximately a 35% improvement in the emissivity characteristics of the very pure 1100-0 spun sheet aluminum alloy parts treated with the nitric acid and hydrofluoric acid bath of the present invention.

It is to be understood that many changes may be made in the specifically described embodiment without departing from the true spirit and scope of the invention and that the invention is to be determined from the scope of the following claims, and not limited to the specifically described embodiment.

What is claimed is:

1. A method of manufacturing a for a liquid at cryogenic temperature Dewar from a can of spun sheet aluminum alloy having a very high percentage of aluminum and from a shell of spun sheet aluminum having a very high percentage of aluminum comprising polishing an exterior surface of the can to a lustrous high gloss thereby substantially removing all tool marks, polishing an interior surface of the shell to a lustrous high gloss thereby substantially removing all tool marks, said exterior and interior surfaces exhibiting a value of $\rho_0$ for radiant emissivity at said cryogenic temperature, chemically treating the exterior surface of the can with a liquid etchant of nitric acid and hydrofluoric acid until the can exterior surface has a non-pitted, smooth, matted, smut free and etched appearance that is free from discoloration and stains, chemically treating the interior surface of the shell with a liquid etchant of nitric acid and hydrofluoric acid until the shell interior surface has a non-pitted, smooth, matted, smut free and etched appearance that is free from discoloration and stains, thereby diminishing said lustrous high gloss and reducing the radiant emissivity for said surfaces at said cryogenic temperature substantially in relation to $\rho_0$ absent corresponding said steps of chemically treating, then assembling the Dewar so that the shell surrounds the can, and evacuating the space between the shell and the can, said etchant approximately 4 percent by volume of hydrofluoric acid and 20 percent by volume of nitric acid and the remainder, deionized water.

2. The method of claim 1, wherein said polishing steps comprise mechanically polishing said interior and exterior surfaces.

3. The method of claim 1, wherein said polishing steps comprise chemically polishing said interior and exterior surfaces and the etchant removes any of the chemicals deposited on the surface by the chemical polishing.

4. The method of claim 1, wherein said polishing steps comprise electrochemically polishing said interior and exterior surfaces.

5. The method of claim 1, wherein said chemically treating steps comprise treating with the etchant for between 15 and 45 seconds.

6. A method of manufacturing a Dewar for a liquid maintained at cryogenic temperature from a can of spun sheet aluminum alloy having a very high percentage of aluminum, from a first shell of spun sheet aluminum alloy having a very high percentage of aluminum, and from a second shell of spun sheet aluminum alloy having a very high percentage of aluminum, the second shell being dimensioned so that it can fit inside the first shell, an exterior surface of the can being polished to a lustrous high gloss so it is substantially free of all tool marks, an interior surface of the first shell being polished to a lustrous high gloss so that substantially all tool marks are removed therefrom, and both interior and exterior surfaces of the second shell being polished to a lustrous high gloss so that substantially all tool marks are removed therefrom, said surfaces exhibiting a value $\rho_0$ for radiant emissivity at said cryogenic temperature, said method comprising: chemically treating the exterior surface of the can with a liquid etchant of nitric acid and hydrofluoric acid until the can exterior surface has a non-pitted, smooth, matted, smut free and etched appearance that is free from discoloration and stains, treating the interior surface of the first shell with a liquid etchant until the interior surface of the first shell has a non-pitted, smooth, matted, smut free and etched appearance that is free from discoloration and stains, treating both the surfaces of the second shell with a liquid etchant until both surfaces of the second shell have non-pitted, smooth, bright, and etched appearances that are free from discoloration and stains, thereby diminishing said lustrous high gloss and reducing the radiant emissivity of each said surfaces in relationship to $\rho_0$ at said cryogenic temperature absent corresponding said steps of treating, then assembling the Dewar so that the second shell surrounds the can, and the first shell surrounds the second shell, and evacuating the space between the first shell and the can, said etchant approximately 4 percent by volume of hydrofluoric acid, approximately 20 percent by volume of nitric acid and the remainder deionized water.

7. A Dewar for containing a liquid maintained at cryogenic temperature manufactured from a can of spun sheet aluminum alloy having a very high percentage of aluminum and from a shell of spun sheet aluminum alloy having a very high percentage of aluminum, an exterior surface of the can being polished to a lustrous high gloss so that substantially all toolmarks are removed therefrom, an interior surface of the shell being polished to a lustrous high gloss so that substantially all toolmarks are removed therefrom, said surfaces exhibiting a value $\rho_0$ for radiant emissivity at said cryogenic temperature, made by the steps of: chemically treating the exterior surface of the can with a liquid etchant of nitric acid and hydrofluoric acid until the can exterior has a non-pitted, smooth, matted, smut-free and etched appearance that is free from discoloration and stains, chemically treating the interior surface of the shell with a liquid etchant of nitric acid and hydrofluoric acid until the shell interior surface has a non-pitted, smooth, matted, smut-free and etched apperance that is free from discoloration and stains, thereby diminishing said lustrous high gloss and reducing radiant emissivity of each of said surfaces at said cryogenic temperature in relation to $\rho_0$ at said cryogenic temperature absent corresponding said steps of treating, then assembling the Dewar so that the shell surrounds the can and then evacuating the space between the shell and the can, said etchant approximately 4 percent by volume of hydrofluoric acid, approximately 20 percent by volume of nitric acid, and the remainder is deionized water.

8. The Dewar of claim 7 wherein the surfaces are treated for between 15 and 45 seconds by the etchant.

* * * * *